US006187979B1

(12) United States Patent
Ido et al.

(10) Patent No.: US 6,187,979 B1
(45) Date of Patent: Feb. 13, 2001

(54) LUBRICATING BASE OIL COMPOSITION AND PROCESS FOR PRODUCING SAME

(75) Inventors: Motohisa Ido; Yukio Yoshida, both of Sodegaura (JP)

(73) Assignee: Idemitsu Kosan Co., Ltd., Tokyo (JP)

( * ) Notice: Under 35 U.S.C. 154(b), the term of this patent shall be extended for 0 days.

(21) Appl. No.: 09/427,762

(22) Filed: Oct. 27, 1999

(30) Foreign Application Priority Data

Nov. 13, 1998 (JP) ..... 10-323707

(51) Int. Cl.[7] ..... C10M 171/00; C10M 111/04
(52) U.S. Cl. ..... 585/10
(58) Field of Search ..... 585/10

(56) References Cited

U.S. PATENT DOCUMENTS 3,595,796 * 7/1971 Duling et al. ..... 585/10
3,843,537 * 10/1974 Duling et al. ..... 585/10
3,966,624 * 6/1976 Duling et al. ..... 585/10
4,371,726 * 2/1983 Horita et al. ..... 585/3

FOREIGN PATENT DOCUMENTS 0 402 881 12/1990 (EP) .
0 508 292 10/1992 (EP) .
0 526 218 2/1993 (EP) .
1 257 472 12/1971 (GB) .
2 224 287 5/1990 (GB) .

* cited by examiner

*Primary Examiner*—Jacqueline V. Howard
(74) *Attorney, Agent, or Firm*—Oblon, Spivak, McClelland, Maier & Neustadt, P.C.

(57) ABSTRACT

A lubricating base oil composition improved in flash point and low temperature fluidity without decreasing the high temperature traction coefficient, and a process for producing the same are provided. The lubricating base oil composition comprises (a) from 80 to 98% by weight of a naphthenic synthetic lubricating base oil having a flash point of 180° C. or less, and (b) from 2 to 20% by weight of a paraffinic synthetic lubricating base oil having a flash point higher than that of the naphthenic synthetic lubricating base oil.

10 Claims, No Drawings

LUBRICATING BASE OIL COMPOSITION AND PROCESS FOR PRODUCING SAME

FIELD OF THE INVENTION

The present invention relates to a lubricating base oil composition and a process for producing a lubricating base oil composition, the flash point and the low temperature fluidity of which are improved, and more particularly, it relates to a lubricating base oil composition that is useful as a fluid for traction drive, the flash point and the low temperature fluidity of which are improved, and a process for producing the same.

BACKGROUND OF THE INVENTION

A base oil for a traction oil used in a traction type CVT (continuously variable transmission) for automobiles necessarily satisfies contradictory conditions, i.e., a high traction coefficient at high temperature and a low viscosity at low temperature, and at the same time, preferably has a flash point of 150° C. or more from the standpoint of safety on practical use. However, synthetic naphthenic compounds having high traction coefficients at high temperature exhibit poor low temperature fluidity. Thus, the low temperature fluidity must be preferentially realized with indispensable slight decrease of the high temperature traction coefficient. In this case, the molecular weight of the compound must be lowered, and as a result, the flash point is decreased to cause a problem of lacking practical utility. That is, because synthetic naphthenic compounds having high traction coefficients at high temperature have higher viscosity than paraffinic compounds having the same molecular weight, the molecular weight of the naphthenic compounds must be low to satisfy the low temperature fluidity. However, the low molecular weight brings about high volatility of the base oil to lower the flash point. It is generally preferred that the flash point of a lubricating oil for an automobile is maintained at 150° C. or more upon practical use. Therefore, there has been a demand that the flash point of the naphthenic synthetic lubricating oil used as a traction oil for an automobile is improved without decreasing the high temperature traction coefficient, so as to satisfy all the high temperature traction coefficient, the low temperature fluidity, and the flash point.

In order to solve the problem of the naphthenic synthetic lubricating oil, there has been conducted an attempt to add a poly-α-olefin (JP-A-1-149898 and JP-A-3-103495). In these techniques, however, since the viscosity of the poly-α-olefin is too high, the addition amount thereof becomes too large to improve the low temperature fluidity, and as a result, the high temperature traction coefficient is greatly decreased. Furthermore, because the poly-α-olefin has a volatility (boiling point) that is greatly different from the naphthenic synthetic lubricating oil, the content of the poly-α-olefin is increased by volatilization of the light component (synthetic naphthenic compound) to greatly lower the high temperature traction coefficient, which causes a problem of gross slip of a CVT.

SUMMARY OF THE INVENTION

The invention has be developed in view of the situation described above, and an object of the invention is to provide a lubricating base oil composition, the flash point and the low temperature fluidity of which are improved without decrease of the high temperature traction coefficient, and a process for producing the same.

As a result of earnest investigations made by the inventors, it has been found that the object of the invention can be effectively accomplished by adding a small amount of a specific paraffinic synthetic base oil for a lubricating oil to a naphthenic synthetic base oil for a lubricating oil, so as to complete the invention.

The invention relates to:

(1) A lubricating base oil composition comprising (a) from 80 to 98% by weight of a naphtmoenic synthetic lubricating base oil having a flash point of 180° C. or less, and (b) from 2 to 20% by weight of a paraffinic synthetic lubricating base oil having a flash point higher than that of the naphthenic synthetic lubricating base oil;

(2) A lubricating base oil composition described in item (1), wherein the naphthenic synthetic lubricating base oil (a) is a compound containing a ring selected from a cyclohexane ring, a bicycloheptane ring, and a bicyclooctane ring;

(3) A lubricating base oil composition described in item (1) or (2), wherein the naphthenic synthetic lubricating base oil (a) is a compound containing at least two rings selected from a cyclohexane ring, a bicyclo[2.2.1]heptane ring, a bicyclo[3.2.1]octane ring, a bicyclo[2.2.2]octane ring, and a bicyclo[3.3.0]octane ring;

(4) A lubricating base oil composition described in one of items (1) to (3), wherein the paraffinic synthetic lubricating base oil (b) is a poly-α-olefin or an α-olefin copolymer;

(5) A lubricating base oil composition described in one of items (1) to (4), wherein the paraffinic synthetic lubricating base oil (b) has from 16 to 40 carbon atoms;

(6) A lubricating base oil composition described in one of items (1) to (4), wherein the paraffinic synthetic lubricating base oil (b) has from 16 to 26 carbon atoms;

(7) A lubricating base oil composition described in items (4) to (6), wherein the poly-α-olefin is a hydrogenated product of a dimer of 1-decene;

(8) A base lubricating oil composition described in one of items (1) to (7), wherein the lubricating base oil composition is a base oil composition of a fluid for traction drive; and (9) A process for producing a lubricating base oil composition that is improved in flash point and low temperature fluidity, the process comprising a step of adding, to (a) from 80 to 98% by weight of a naphthenic synthetic lubricating base oil having a flash point of 180° C. or less, (b) from 2 to 20% by weight of a paraffinic synthetic lubricating base oil having a flash point higher than that of the naphthenic synthetic lubricating base oil.

DETAILED DESCRIPTION OF THE INVENTION

The invention will be described in detail below.

The naphthenic synthetic base oil for a lubricating oil having a flash point of 180° C. or less as the component (a) of the base oil for a lubricating oil according to the invention is not particularly limited as far as it has a flash point of 180° C. or less. It is preferably a compound containing a ring selected from a cyclohexane ring, a bicycloheptane ring, and a bicyclooctane ring. More preferably, it is a compound containing at least two rings selected from a cyclohexane ring, a bicyclo[2.2.1]heptane ring, a bicyclo[3.2.1]octane ring, a bicyclo[2.2.2]octane ring, and a bicyclo[3.3.0]octane ring.

Preferred specific examples thereof include a hydrogenated product of a dimer of at least one alicyclic compound selected from a compound containing a bicyclo[2.2.1]heptane ring, a compound containing a bicyclo[3.2.1]octane ring, a compound containing a bicyclo[3.3.0]octane ring, and a compound containing a bicyclo[2.2.2]octane ring, and a compound containing cyclohexane ring, such as 2,4-dicyclohexyl-2-methylpentane, 2,4-dicyclohexylpentane, 2,4-dicyclohexyl-2-methylbutane, and 1-decahydronaphthyl-1-cyclohexylethane.

As a preferred example of a process for producing the hydrogenated product of a dimer of the alicyclic compound, an olefin described below, which may have an alkyl group as a substituent, may be subjected to dimerization, hydrogenation, and distillation, in this order.

Examples of the olefin, which may have an alkyl group, such as a methyl group, an ethyl group and a propyl group, as a substituent include bicyclo[2.2.1]hept-2-ene; an alkenyl-substituted bicyclo[2.2.1]hept-2-ene, such as vinyl-substituted or isopropenyl-substituted bicyclo[2.2.1]hept-2-ene; an alkylidene-substituted bicyclo[2.2.1]hept-2-ene, such as methylene-substituted, ethylidene-substituted or isopropylidene-substituted bicyclo[2.2.1]hept-2-ene; an alkenyl-substituted bicyclo[2.2.1]heptane, such as vinyl-substituted or isopropenyl-substituted bicyclo[2.2.1]heptane; an alkylidene-substituted bicyclo[2.2.1]heptane, such as methylene-substituted, ethylidene-substituted or isopropylidene-substituted bicyclo[2.2.1]heptane; bicyclo[3.2.1]octene; an alkenyl-substituted bicyclo[3.2.1]octene, such as vinyl-substituted or isopropenyl-substituted bicyclo[3.2.1]octene; an alkylidene-substituted bicyclo[3.2.1]octene, such as methylene-substituted, ethylidene-substituted or isopropylidene-substituted bicyclo[3.2.1]octene; an alkenyl-substituted bicyclo[3.2.1]octane, such as vinyl-substituted or alkenyl-substituted bicyclo[3.2.1]octane; an alkylidene-substituted bicyclo[3.2.1]octane, such as methylene-substituted, ethylidene-substituted or isopropylidene-substituted bicyclo[3.2.1]octane; bicyclo[3.3.2]octene; an alkenyl-substituted bicyclo[3.3.2]octene, such as vinyl-substituted or isopropenyl-substituted bicyclo[3.3.0]octene; an alkylidene-substituted bicyclo[3.3.0]octene, such as methylene-substituted, ethylidene-substituted or isopropylidene-substituted bicyclo[3.3.0]octene; an alkenyl-substituted bicyclo[3.3.0]octane, such as vinyl-substituted or isopropenyl-substituted bicyclo[3.3.0]octane; an alkylidene-substituted bicyclo[3.3.0]octane, such as methylene-substituted, ethylidene-substituted or isopropylidene-substituted bicyclo[3.3.0]octane; bicyclo[2.2.2]octene; an alkenyl-substituted bicyclo[2.2.2]octene, such as vinyl-substituted or isopropenyl-substituted bicyclo[2.2.2]octene; an alkylidene-substituted bicyclo[2.2.2]octene, such as methylene-substituted, ethylidene-substituted or isopropylidene-substituted bicyclo[2.2.2]octene; an alkenyl-substituted bicyclo[2.2.2]octane, such as vinyl-substituted or isopropenyl-substituted bicyclo[2.2.2]octane; and an alkylidene-substituted bicyclo[2.2.2]octane, such as methylene-substituted, ethylidene-substituted or isopropylidene-substituted bicyclo[2.2.2]octane.

Among these compounds, a hydrogenated product of a dimer of a compound containing a bicyclo[2.2.1]heptane ring is particularly preferred. Examples of an olefin as a corresponding raw material include bicyclo[2.2.1]hept-2-ene, 2-methylenebicyclo[2.2.1]heptane, 2-methylbicyclo[2.2.1]hept-2-ene, 2-methylene-3-methylbicyclo[2.2.1]heptane, 3-methylene-2-methylbicyclo[2.2.1]heptane, 2,3-dimethylbicyclo[2.2.1]hept-2-ene, 2-methylene-7-methylbicyclo[2.2.1]heptane, 3-methylene-7-methylbicyclo[2.2.1]heptane, 2,7-dimethylbicyclo[2.2.1]hept-2-ene, 2-methylene-5-methylbicyclo[2.2.1]heptane, 3-methylene-5-methylbicyclo[2.2.1]heptane, 2,5-dimethylbicyclo[2.2.1]hept-2-ene, 2-methylene-6-methylbicyclo[2.2.1]heptane, 3-methylene-6-methylbicyclo[2.2.1]heptane, 2,6-dimethylbicyclo[2.2.1]hept-2-ene, 2-methylene-1-methylbicyclo[2.2.1]heptane, 3-methylene-1-methylbicyclo[2.2.1]heptane, 1,2-dimethylbicyclo[2.2.1]hept-2-ene, 2-methylene-4-methylbicyclo[2.2.1]heptane, 3-methylene-4-methylbicyclo[2.2.1]heptane, 2,4-dimethylbicyclo[2.2.1]hept-2-ene, 2-methylene-3,7-dimethylbicyclo[2.2.1]heptane, 3-methylene-2,7-dimethylbicyclo[2.2.1]heptane, 2,3,7-trimethylbicyclo[2.2.1]hept-2-ene, 2-methylene-3,6-dimethylbicyclo[2.2.1]heptane, 3-methylene-2,6-dimethylbicyclo[2.2.1]heptane, 2-methylene-3,3-dimethylbicyclo[2.2.1]heptane, 3-methylene-2,2-dimethylbicyclo[2.2.1]heptane, 2,3,6-trimethylbicyclo[2.2.1]hept-2-ene, 2-methyelne-3-ethylbicyclo[2.2.1]heptane, 3-methyelne-2-ethylbicyclo[2.2.1]heptane, and 2-methyl-3-ethylbicyclo[2.2.1]hept-2-ene.

The dimerization includes not only the dimerization of plural olefin molecules of the same kind, but also the dimerization of olefin molecules of different kinds.

The dimerization of olefin is generally conducted in the presence of a catalyst, to which a solvent is added depending on necessity.

As the catalyst used in the dimerization, an acidic catalyst is generally employed. Examples of the acidic catalyst include a solid acid, such as activated clay, zeolite, montmorillonite and an ion exchange resin; a mineral acid, such as hydrofluoric acid and polyphosphoric acid; an organic acid, such as triflic acid; a Lewis acid, such as aluminum chloride, ferric chloride, stannic chloride, boron trifluoride, a boron trifluoride complex, boron tribromide, aluminum bromide, gallium chloride, and gallium bromide; and an organic aluminum compound, such as triethylaluminum, diethylaluminum chloride and ethylaluminum dichloride.

The used amount of the catalyst is not particularly limited, and is generally from 0.1 to 100% by weight based on the amount of the olefin as a raw material.

While a solvent is not necessarily used on the dimerization, it maybe used for handling the raw material olefin and the catalyst, and for adjusting the progress of the reaction. Examples of the solvent include a saturated hydrocarbon, such as pentanes, hexanes, octanes, nonanes and decanes; an alicyclic hydrocarbon, such as cyclopentane, cyclohexane, methylcyclohexane and decalin; an ether compound, such as diethyl ether and tetrahydrofuran; a halogen-containing compound, such as methylene chloride and dichloroethane; and a nitro compound, such as nitromethane and nitrobenzene.

Upon conducting the dimerization reaction in the presence of the catalyst, the reaction temperature is generally from -70 to 200° C. While the suitable conditions are set within the temperature range depending on the kind of the catalyst and the additives used, the reaction pressure is generally normal pressure, and the reaction time is generally from 0.5 to 10 hours.

The resulting dimer of the raw material olefin is then hydrogenated to obtain the objective hydrogenated product of the dimer. The hydrogenation may be conducted for a mixture of dimers, which are separately produced by dimerization of different raw material olefins, respectively.

The hydrogenation reaction is generally conducted in the presence of a catalyst, and examples of the catalyst include a hydrogenation catalyst, such as nickel, ruthenium, palladium, platinum, rhodium and iridium. The used amount of the catalyst is generally from 0.1 to 100% by weight based on the amount of the product of dimerization.

While the hydrogenation reaction may be conducted without a solvent, it may also be conducted in the presence of a solvent as similar to the dimerization reaction. Examples of the solvent in this case include a saturated hydrocarbon, such as pentanes, hexanes, octanes, nonanes and decanes; and an alicyclic hydrocarbon, such as cyclopentane, cyclohexane, methylcyclohexane and decalin.

The reaction temperature is generally in the range of from 20 to 300° C., and the reaction pressure is generally in the range of from normal pressure to 200 kg/cm$^2$G. The resulting hydrogenated product may be mixed with a hydrogenated product produced through another process using another raw material olefin, and used as a base oil of a fluid for traction drive.

Examples of the paraffinic synthetic lubricating base oil as the component (b) having a flash point higher than the component (a) includeapoly-α-olefin and anα-olefin copolymer. The poly-α-olefin includes a hydrogenated product of an oligomer of an α-olefin having from 2 to 20 carbon atoms, and the total carbon number of which is preferably from 16 to 40, particularly preferably from 16 to 26. A hydrogenated product of a dimer of 1-decene is particularly preferred.

The α-olefin copolymer includes a hydrogenated product of a copolymer of an α-olefin having from 3 to 20 carbon atoms and ethylene, and the total carbon number thereof is preferably from 16 to 40, particularly preferably from 16 to 26. The total carbon number of the other paraffinic synthetic base oil for a lubricating oil than the poly-α-olefin and the a-olefin copolymer is also preferably from 16 to 40, particularly preferably from 16 to 26. When the total carbon number is less than 16, the flash point becomes 150° C. or less, and when the total carbon number exceeds 40, it is not preferred since the low temperature viscosity is decreased to make the addition amount large, and as a result, the traction coefficient is greatly lowered.

The lubricating base oil composition can be obtained by mixing the component (a) and the component (b). The proportion of the component (a) and the component (b) is from 80 to 98% by weight of the component (a) and from 2 to 20% by weight of the component (b)i, based on the total amount of the component (a) and the component (b).

When the proportion of the component (b) is less than 2% by weight, the effect of improvement in flash point and low temperature fluidity is small, and when it exceeds 20% by weight, the high temperature traction coefficient of the composition is lowered. The proportion of the component (b) is preferably from 3 to 18% by weight, and thus the preferred proportion of the component (a) is from 82 to 97% by weight.

In the invention, a base oil other than the component (a) and the component (b) maybe added in an amount range that does not impair the object of the invention.

To the lubricating base oil composition, various additives, such as an antioxidant, a rust preventing agent, a detergent dispersant, a pour point depressant, a viscosity index improver, an extreme pressure agent, an anti-abrasion agent, an oiliness agent, a defoaming agent, and a corrosion preventing agent.

The lubricating base oil of the lubricating base oil composition according to the invention can be used as a fluid for traction drive, a transmission fluid, a hydraulic fluid, a compressor oil and an electric insulating oil, and among these, it is preferably used as a fluid for traction drive.

The invention also provides a process for producing a base oil composition for a lubricating oil that is improved in flash point and low temperature fluidity, the process comprising a step of adding, to (a) from 80 to 98% by weight of a naphthenic synthetic base oil for a lubricating oil having a flash point of 180° C. or less, (b) from 2 to 20% by weight of a paraffinic synthetic lubricating base oil having a flash point higher than that of the naphthenic synthetic lubricating base oil. The component (a) and the component (b) have been described in the foregoing.

In the invention, the flash point is unexpectedly increased beyond the value that is simply expected from the additivity of the component (a) and the component (b) While the reason of such a phenomenon is not clear, it is expected that because the components to be mixed are the typical naphthenic compound and the typical paraffinic compound, which are greatly different from each other in molecular structure, they are dissolved in each other but are not completely mixed in am icroscopic view, and the high flash point of the paraffinic compound contribute greatly to the flash point of the whole composition due to the paraffinic compound having the high flash point localized at the surface of the liquid.

The invention will be described in more detail with reference to the examples below, but the invention is not construed as being limited to the examples.

COMPARATIVE EXAMPLE 1

350.5 g (5 mol) of crotonaldehyde and 198.3 g (1.5 mnol) of dicyclopentadiene were charged in a 1-L stainless steel autoclave and reacted by stirring at 170° C. for 2 hours. After cooling the reaction solution to room temperature, 22 g of a 5% ruthenium-carbon catalyst (produced by N.E. Chemcat Corp.) was added thereto, and hydrogenation was conducted at a hydrogen pressure of t 70 kg/cm$^2$G and a reaction temperature of 180° C. for 4 hours. After cooling and filtering the catalyst, the filtrate was distilled under reduced pressure to obtain 242 g of a fraction of 70° C./0.9 Torr. The fraction was analyzed with mass spectrum and nuclear magnetic resonance spectrum, and it was found that the fraction was 2-hydroxymethyl-3-methylbicyclo[2.2.1] heptane and 3- hydroxymethyl-2-methylbicyclo [2.2.] heptane.

Subsequently, 15 g of γ-alumina (Norton Alumina SA-6273 produced by Nikka Seiko Co., Ltd.) was placed in a flowing type normal pressure reaction tube made of quartz glass having an outer diameter of 20 mm and a length of 500 mm, and a dehydration reaction was conducted at a reaction temperature of 270° C. and a weight hourly space velocity (WHSV) of 1.07 hr$^{-1}$, to obtain 196 g of a dehydration reaction product of 2-hydroxymethyl-3-dimethylbicyclo [2.2. ]heptane and 3-hydroxymethyl-2-dimethylbicyclo [2.2.1]heptane containing 65% by weight of 2-methylene-3-methylbicyclo[2.2.1]heptane and 3-methylene-2-methylbicyclo[2.2.1]heptane and 28% by weight of 2,3-dimethylbicyclo[2.2.1]hept-2-ene. The composition of the dehydration reaction product was confirmed with gas chromatography.

(Preparation of Hydrogenated Product of Dimer)

9.5 g of activated clay (Galleon Earth NS produced by Mizusawa Industrial Chemicals, Ltd.) and 190 g of the olefin compound thus obtained were placed in a 500-ml four-neck flask, and a dimerization reaction was conducted by stirring at 145° C. for 3 hours. After the activated clay was filtered out from the reaction mixture, 6 g of a nickel/diatomaceous earth catalyst (N-113 produced by Nikki Chemical Co., Ltd.) was added to a 1-L autoclave, and a hydrogenation reaction was conducted under the condition of a hydrogen pressure of 40 kg/cm$^2$G, a reaction temperature of 160° C. and a reaction time of 4 hours. After completing the reaction, the catalyst was removed by filtration, and the filtrate was distilled under reduced pressure, to obtain 116 g of a hydrogenated product of the dimer as a fraction having a boiling point of from 126 to 128° C./0.2 mmHg. It was confirmed with mass spectrum and nuclear magnetic resonance spectrum that the fraction was the hydrogenation product of the dimer. The general properties and the traction coefficient of the hydrogenated product of the dimer are shown in Table 1.

EXAMPLE 1

To the base oil obtained in Comparative Example 1, a hydrogenated product of a dimer of 1-decene (PAO-5002 produced by Idemitsu Petrochemical Co., Ltd., flash point: 171° C.) was added in an amount of 10% by weight based on the total amount of the composition. The general properties and the traction coefficient of the composition are shown in Table 1.

COMPARATIVE EXAMPLE 2

4 g of activated clay (Galleon Earth NS produced by Mizusawa Industrial Chemicals, Ltd.), 10 g of diethylene glycol monoethyl ether and 200 g of α-methylstyrene were placed in a 500-ml four-neck flask equipped with a reflux condenser, a stirrer and a thermometer, and stirred for 4 hours. After completing the reaction, the resulting solution was analyzed with gas chromatography, and it was found that the conversion ratio was 70%, the selectivity of the objectivea-methylstyrene linear dimer was 95%, the selectivity of the by-produced α-methylstyrene cyclic dimer was 1%, and the selectivity of high boiling point product, such as a trimer, was 4%. The reaction product was subjected to the hydrogenation and the distillation under reduced pressure in the same manner as in Comparative Example 1, so as to obtain a hydrogenated product of the α-methylstyrene linear dimer having a purity of 99% by weight, i.e., 125 g of 2,4-dicyclohexyl-2-methylpentane. It was confirmed with mass spectrum and nuclear magnetic resonance spectrum that the product was 2, 4-dicyclohexyl-2-methylpentane. The purity thereof was confirmed with gas chromatography. The general properties and the traction coefficient of the hydrogenated product of the dimer are shown in Table 1.

EXAMPLE 2

To the base oil obtained in Comparative Example 2, a hydrogenated product of a dimer of 1-decene (PAO-5002 produced by Idemitsu Petrochemical Co., Ltd., flash point: 171° C.) was added in an amount of 15% by weight based on the total amount of the composition. The general properties and the traction coefficient of the composition are shown in Table 1.

COMPARATIVE EXAMPLE 3

2,700 g of ethylbenzene, 58 g of metallic sodium and 17 g of isopropyl alcohol were placed in a 5-L glass flask, and 1,100 g of α-methylstyrene and 300 g of ethylbenzene were gradually added dropwise thereto over 5 hours under heating to 120° C. and stirring, followed by further stirring for 1 hour, to conduct a reaction.

After completing the reaction, an oily layer was separated and recovered by cooling, and 200 g of methyl alcohol was added thereto, which was washed with 2 L of a 5N-aqueous solution of hydrochloric acid and 2 L of a saturated aqueous solution of sodium chloride three times respectively. After drying over sodium sulfate anhydride, unreacted ethylbenzene was distilled out with a rotary evaporator, and 1,500 g of a fraction having a boiling point in the range of from 104 to 110° C. at 0.06 Torr was obtained by further conducting distillation under reduced pressure. It was confirmed with mass spectrum and nuclear magnetic resonance spectrum that the fraction was 2,4-diphenylpentane.

Subsequently, 500 ml of the fraction was placed in a 1-L autoclave, to which 20 g of a nickel catalyst for hydrogenation (N-113 produced by Nikki Chemical Co., Ltd.) was added, and the hydrogenation treatment was conducted under the conditions of a reaction temperature of 200° C. and a hydrogen pressure of 50 kg/cm$^2$G. After completing the reaction, the catalyst was removed, and the light component was stripped and analyzed with nuclear magnetic resonance spectrum. As a result, it was confirmed that the hydrogenation ratio was 99% or more, and the 420 g of the hydrogenation product was 2,4-dicyclohexylpentane. The general properties and the traction coefficient of the hydrogenated product are shown in Table 1.

EXAMPLE 3

To the base oil obtained in Comparative Example 3, a hydrogenated product of a dimer of 1-decene (PAO-5002 produced by Idemitsu Petrochemical Co., Ltd., flash point: 171° C.) was added in an amount of 5% by weight based on the total amount of the composition. The general properties and the traction coefficient of the composition are shown in Table 1.

COMPARATIVE EXAMPLE 4

To the base oil obtained in Comparative Example 1, the base oil obtained in Comparative Example 3 was added in an amount of 10% by weight. The general properties and the traction coefficient of the composition are shown in Table 1.

In Examples and Comparative Examples, the kinematic viscosity and the viscosity index were measured according to JIS K2283, the pour point was measured according to JIS K2269, the flash point was measured according to JIS K2265, and the low temperature viscosity was measured according to ASTM D2983.

The measurement of the traction coefficient was conducted with a double cylinder friction tester. That is, one of the two cylinders in contact with each other (each having a diameter of 52 mm and a thickness of 6 mm, the cylinder to be driven of which was of a drum shape having a curvature of 10 mm, and the driving cylinder of which was of a flat type without crowning) was rotated at a constant speed, and the other was rotated at a speed continuously varied. A load of 98.0 N was applied to the part, at which the cylinders were in contact with each other, and the tangential force generated between the cylinders, i.e., the traction force, was measured to obtain the traction coefficient. The cylinder was made of a bearing steel SUJ-2 with mirror finish, the average circumferential speed was 6.8 m/s, and the maximum Hertzian contact pressure was 1.23 Gpa. Upon measuring the traction coefficient at a fluid temperature (oil temperature) of 140° C., the oil temperature was increased from 40° C. to 140° C. by heating an oil tank by a heater, and a traction coefficient at a slide/roll ratio of 5% was obtained.

TABLE 1

| | Comparative Example 1 | Example 1 | Comparative Example 2 | Example 2 | Comparative Example 3 | Example 3 | Comparative Example 4 |
|---|---|---|---|---|---|---|---|
| Kinematic viscosity (40° C.) ($mm^2/s$) | 22.38 | 19.36 | 20.23 | 15.49 | 11.82 | 11.29 | 22.42 |
| Kinematic viscosity (100° C.) ($mm^2/s$) | 4.007 | 3.722 | 3.572 | 3.118 | 2.722 | 2.656 | 4.014 |
| Viscosity index | 52 | 60 | 13 | 29 | 48 | 51 | 53 |
| Pour point (° C.) | −45.0 | −50.0 | −42.5 | −50.0 | −57.5 | −60.0> | −50.0 |
| Low temperature viscosity (−40° C.) (mPa · s) | 200,000 | 130,000 | 300,000< | 120,000 | 30,000 | 15,000 | 150,000 |
| Traction coefficient (140° C.) | 0.083 | 0.070 | 0.070 | 0.051 | 0.058 | 0.052 | 0.080 |
| Flash point (° C.) | 158 | 165 | 163 | 170 | 163 | 168 | 158 |

It was confirmed from the results shown in Table 1 that the low temperature fluidity (low temperature viscosity) and the flash point were improved in Examples.

It has been known that the low temperature viscosity and the high temperature traction coefficient are in contradictory relationship, and when the low temperature viscosity is improved (lowered), the high temperature traction coefficient is lowered. The comparison between Comparative Example 1 and Example 1 using the same naphthenic synthetic lubricating base oil reveals that Example 1 is greatly improved in low temperature viscosity, but decrease of the high temperature traction coefficient is small. Similarly, the comparison between Comparative Example 2 and Example 2 reveals that Example 2 is further greatly improved in low temperature viscosity, and the high temperature traction coefficient is lowered associated thereto. In general, when the lowering rate of the high temperature traction coefficient is 30% or less, the base oil can be used as a fluid for traction drive without any problem. The lowering rate of the high temperature traction coefficient of Example 2 is about 27%, which is in the range causing no problem. That is, Example 2 shows a lubricating base oil improved in flash point and low temperature fluidity without decreasing the high temperature traction coefficient. Similarly, the comparison between Comparative Example 3 and Example 3 reveals that Example 3 is greatly improved in low temperature viscosity, but the lowering of the high temperature traction coefficient is considerably small.

As described in the foregoing, it has been confirmed that in Examples according to the invention, an lubricating base oil that is improved in flash point and low temperature fluidity without decreasing the high temperature traction coefficient.

The lubricating base oil composition according to the invention has a high traction coefficient at a high temperature and is excellent in low temperature flowing characteristics, with a sufficiently high flash point. Therefore, it can be practically used as a fluid for a traction drive type CVT around the world including cold districts and high temperature regions.

What is claimed is:

1. A lubricating base oil composition comprising (a) from 80 to 98% by weight of a naphthenic synthetic lubricating base oil having a flash point of 180° C. or less, and (b) from 2 to 20% by weight of a paraffinic synthetic lubricating base oil having a flash point higher than that of said naphthenic synthetic lubricating base oil.

2. A lubricating base oil composition as claimed in claim 1, wherein said naphthenic synthetic lubricating base oil (a) is a compound containing a ring selected from a cyclohexane ring, a bicycloheptane ring, and a bicyclooctane ring.

3. A lubricating base oil composition as claimed in claim 2, wherein said naphthenic synthetic lubricating base oil (a) is a compound containing at least two rings selected from a cyclohexane ring, a bicyclo[2.2.1]heptane ring, a bicyclo[3.2.1]octane ring, a bicyclo[2.2.2]octane ring, and a bicyclo[3.3.0]octane ring.

4. A lubricating base oil composition as claimed in claim 2 or 3, wherein said paraffinic synthetic lubricating base oil (b) is a poly-α-olefin or an α-olefin copolymer.

5. A lubricating base oil composition as claimed in claim 4, wherein said paraffinic synthetic lubricating base oil (b) has from 16 to 40 carbon atoms.

6. A lubricating base oil composition as claimed in claim 4, wherein said paraffinic synthetic lubricating base oil (b) has from 16 to 26 carbon atoms.

7. A lubricating base oil composition as claimed in claim 5, wherein said poly-α-olefin is a hydrogenated product of a dimer of 1-decene.

8. A base lubricating oil composition as claimed in claim 1 or 3, wherein said lubricating base oil composition is a base oil composition of a fluid for traction drive.

9. A base lubricating oil composition as claimed in claim 4, wherein said lubricating base oil composition is abase oil composition of a fluid for traction drive.

10. A process for producing a lubricating base oil composition that is improved in flash point and low temperature fluidity, said process comprising a step of adding, to (a) from 80 to 98% by weight of a naphthenic synthetic lubricating base oil having a flash point of 180° C. or less, (b) from 2 to 20% by weight of a paraffinic synthetic lubricating base oil having a flash point higher than that of said naphthenic synthetic lubricating base oil.

* * * * *